US006095428A

United States Patent [19]

Wells

[11] Patent Number: 6,095,428

[45] Date of Patent: Aug. 1, 2000

[54] WATER-POWERED AIRCRAFT LAWN SPRINKLER

[76] Inventor: David S. Wells, 165 S. Western, Aurora, Ill. 60506

[21] Appl. No.: 09/348,504

[22] Filed: Jul. 7, 1999

[51] Int. Cl.[7] ..... B05B 17/00

[52] U.S. Cl. ..... 239/1; 239/211; 239/251; 239/281; 244/136

[58] Field of Search ..... 239/273, 280, 239/280.5, 281, 289, 211, 251, 171, 548, 550, 1; 244/136

[56] References Cited

U.S. PATENT DOCUMENTS

| | | | |
|---|---|---|---|
| 2,954,932 | 10/1960 | Albano | 239/211 |
| 3,700,172 | 10/1972 | Gallegos, Sr. | 244/136 |
| 4,274,591 | 6/1981 | Sunshine et al. | 239/211 |
| 4,948,068 | 8/1990 | Van Horn | 239/211 |
| 5,322,219 | 6/1994 | Esplin | 239/171 |
| 5,419,494 | 5/1995 | Harwood | 239/211 |
| 6,003,782 | 12/1999 | Kim et al. | 239/171 |

*Primary Examiner*—Andres Kashnikow
*Assistant Examiner*—Lisa Ann Douglas
*Attorney, Agent, or Firm*—Hill & Simpson

[57] ABSTRACT

A water-powered aircraft/sprinkler utilizes an airfoil and a water jet nozzle power source to provide a manually maneuverable aircraft/sprinkler supplied with a pressurized water stream through a movable boom and a portable stationary gantry.

21 Claims, 3 Drawing Sheets

FIG. 11
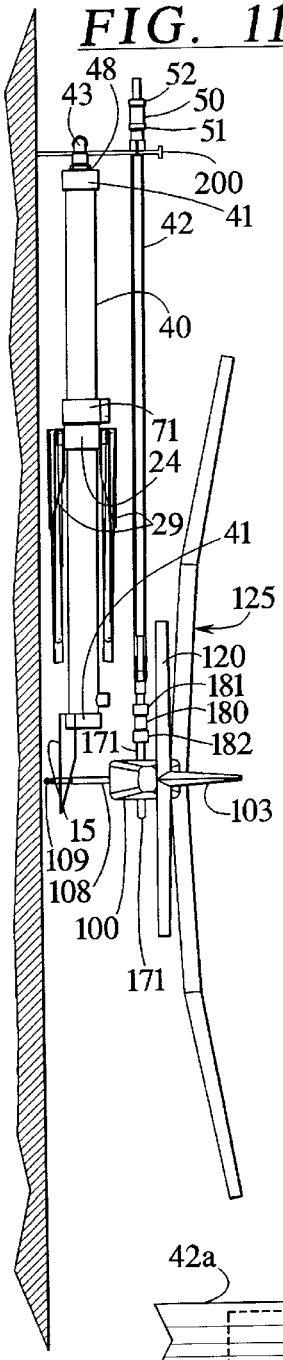
FIG. 2
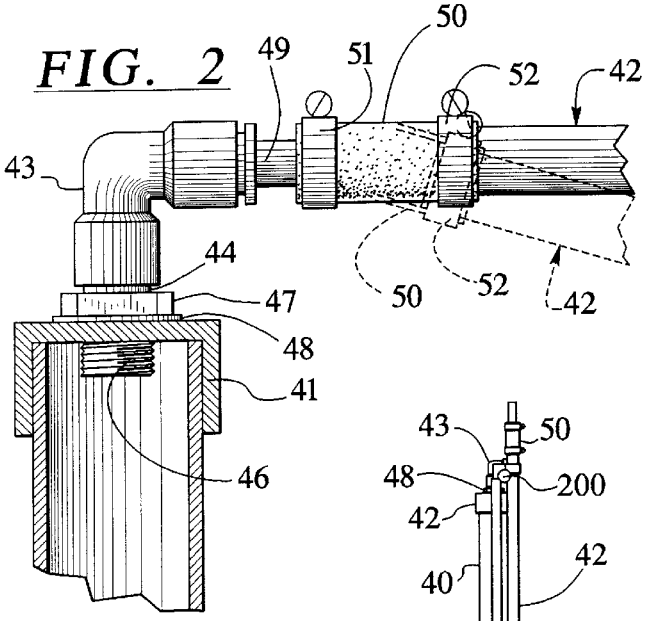
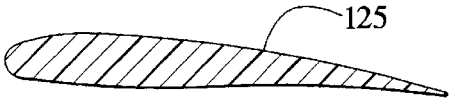
FIG. 10
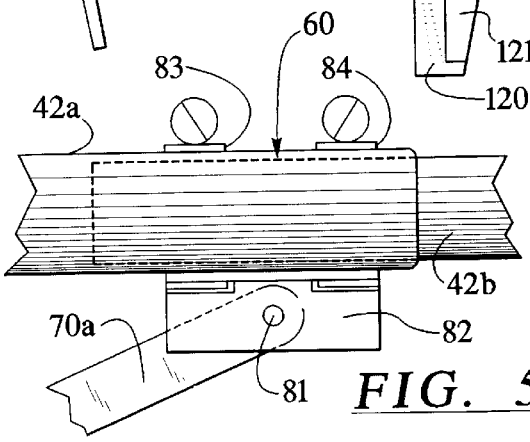
FIG. 5
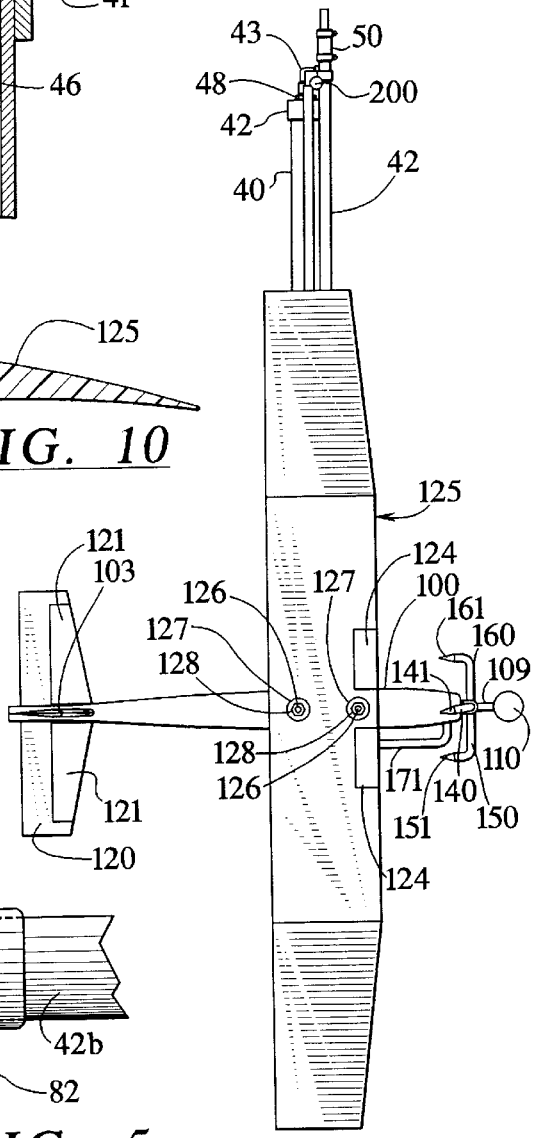
FIG. 12

WATER-POWERED AIRCRAFT LAWN SPRINKLER

FIELD OF THE INVENTION

This invention relates generally to lawn sprinklers and more particularly relates to a lawn sprinkler constructed in the form and size of a model airplane having an airfoil and powered by dynamic thrust forces derived from a flowing stream of water.

THE PRIOR ART

The prior art is exemplified by lawn sprinklers of various types and configurations and which are usually characterized by one or more nozzles carried on the end of a rotatable arm so that the arm will be rotated about a permanent fixed axis. With some sprinklers, for example, the usual form of sprinkler used on large expanses such as a golf course fairway, or a golf course green, the nozzle will be equipped with a stepping device so that the sprinkler is, in effect, rotated in stepped increments, or arcuate segments, while traversing a generally circular path.

In the art of toy airplanes, i.e., model airplanes of the heavier-than-air category, are provided with an airfoil and stabilizer and may be powered by various means suitable for producing thrust which will propel the plane forwards. Controls may, or may not, be provided which sometimes include tethers so that the operator of the airplane may control the flight characteristics of the plane in selected modes of take-off, flight, and landing.

SUMMARY OF THE PRESENT INVENTION

The present invention contemplates the utilization of a portable assembly which includes a heavier-than-air aircraft which is sized and shaped in the configuration of a model airplane, or helicopter, and which is capable of being kept aloft by the upward thrust exerted by the passing air on its fixed wing airfoil. A helicopter type aircraft may also be employed, in which event, lift is produced by the blades of a rotor. The aircraft is driven in the modes of take-off, flight, and landing by the thrust produced by water jets, which water jets are further utilized to water the area subjacent a prescribed flight path. The aircraft can be manipulated selectively during the course of its watering function by selective control of a water stream directed to the aircraft by a gantry and boom.

DESCRIPTION OF THE DRAWINGS

FIG. 2 is an enlarged fragmentary view showing additional details of the boom attachment to the gantry, as depicted in smaller scale in FIG. 1.

FIG. 5 is a fragmentary cross-sectional view of the connection of the strut to the boom.

FIG. 10 is a profile cross-section of the airfoil, or wing, of the airplane component of FIG. 6.

FIG. 11 is a side elevational view of the plane, gantry, boom and strut assembly of the present invention in stored position.

FIG. 12 is a front elevational view of the stored assembly of FIG. 11.

DESCRIPTION OF THE PREFERRED EMBODIMENTS

Figure 1:
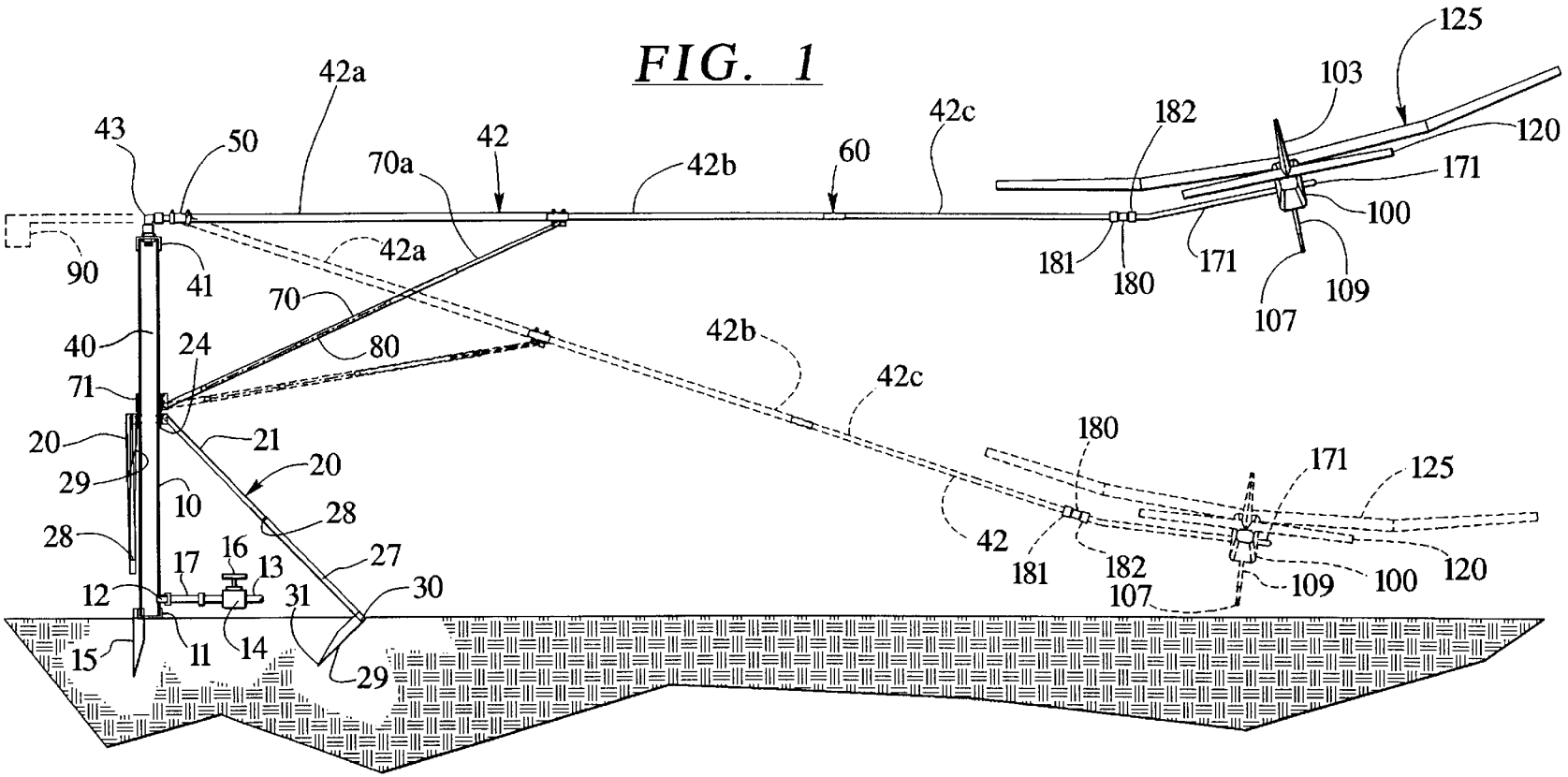
FIG. 1 is a side elevational view of a water powered airplane lawn sprinkler of the present invention fully deployed in an operational mode, but with parts broken away, and with some parts shown in cross-section to reveal features of construction.

Referring to FIG. 1 of the drawings, there is shown an exemplary form of a water powered airplane lawn sprinkler in fully deployed status. While the present disclosure features the utilization of what could be characterized as a propeller driven aircraft, it should be appreciated that the principles of the present invention could be effectively applied to other aircraft configurations such as a so-called helicopter, or a jump-jet.

A gantry 10 to which the aircraft may be tethered is constituted by an upright vertical cylindrical tube preferably made of a rigid material such as metal. The gantry 10 is capped by a closure 11 at its lower end and includes an angle stake 15 to assist in planting the gantry at a selected fixed position and is fitted with a coupling 12 for connection to the usual source of domestic water supply such a common garden hose 17. Such a typical source of pressured water is exemplified by a schematic showing of a conduit 13 having a flow control means, or valve 14 regulated by a hand-manipulable actuator 16. The usual domestic water supply systems in most municipalities within the United States operate at a water pressure in the range of 40 to 100 pounds per square inch (p.s.i.), depending on the location of the user relative to a pumping station, or the pressurizing source. A range of pressure of 40 to 50 p.s.i. has been found satisfactory for achieving the objectives of this invention. A socket coupling fitting for a garden hose socket coupling fitting is shown at 17 for connection to the coupling 12.

In order to mount the gantry 10 in a selected area to be watered, the gantry 10 is provided with three collapsible channel legs 20. Each leg 20 has an upper section 21 pivotally connected by a pivot pin 22 to a channel bracket 23 connected in firm assembly to a union member 24 fastened to the gantry 10 by fastening members 26, for example, rivets, or screws.

Each channel leg 20 has a lower section 27 which may be folded closed, as shown on the left side of the gantry 10 in FIG. 1, or folded to an open position, as shown on the right side of the gantry 10 in FIG. 1, by virtue of a pivot pin coupling 28 between the upper and lower channel leg sections 21 and 27.

An angle stake 29 is pivotally connected to the end of the lower section 27 of each channel leg 20 as at 30, thereby permitting the stake 29 to be positioned at right angles to the leg 20 so that a pointed end 31 may be driven into the ground to firmly anchor the gantry 20 securely in place. It will be understood that the three legs 20 are circumferentially spaced apart from one another on the periphery of the gantry 10 in order to enhance the stability of the gantry 20 and to establish a fixed vertical axis for the sprinkler arrangement.

The interior of the gantry 10 is hollow and forms a flow passage 40 through which a pressurized stream of water may be selectively directed at controlled metered rates under the regulation of an operator manipulating the actuator 16 on the control valve 14.

Referring to FIG. 2 in connection with FIG. 1, it will be noted that the top of the gantry 10 is capped by a pipe cap 41. Moreover, a boom 42 is rotatably connected to the upper end of the gantry 10 and provides an extension of the liquid circuit in which the liquid stream of water is driven in a radially outwardly direction relative to the center post axis established by the gantry 10.

To effect the rotatable coupling of the boom 42 to the gantry 10, a swivel elbow 43 has one arm that is connected for rotation relative to a transition member 44, which, in turn, is formed with pipe threads 46 engaged with mating threads in the pipe cap 41 and securely locked in assembly with the pipe cap 41 by means of a lock nut 47 and a sealing washer 48. The other arm of the swivel elbow 43 is connected to a second transition member 49.

In order to accommodate vertical displacement of the boom 42 relative to the gantry 10, the second transition member 49 and the boom 42 are interconnected with one another by a short piece of flexible hose 50. One end of the flexible hose 50 overlaps on the end of the second transition member 49 and is mechanically and hydraulically locked thereto by a hose clamp 51. The opposite end of the hose 50 is mechanically and hydraulically locked on the end of the boom 42 by means of a hose clamp 52. Thus, the boom 42 may extend horizontally and radially outwards from the gantry 10 and is free to rotate relative thereto in a plane normal to the vertical axis of the gantry 10, an orientation depicted in FIG. 1 by the full lines of FIG. 1. However, as shown by the phantom line depiction of FIG. 1, the boom 42 is susceptible to tilting which will be accommodated by the flexible hose 50, the utilitarian purpose of which feature will become manifest as the disclosure proceeds.

Figure 4:
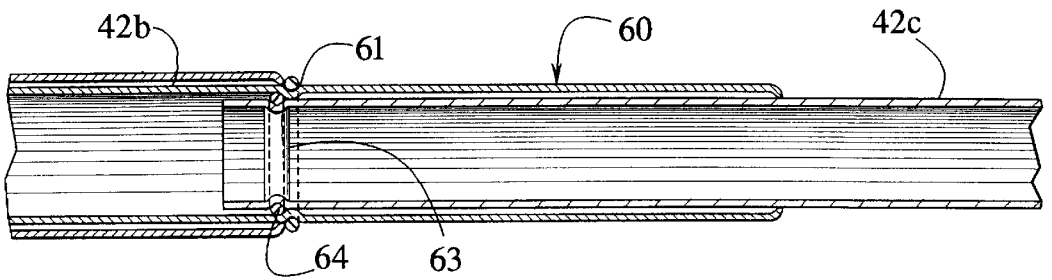
FIG. 4 is a fragmentary cross-sectional view taken on FIG. 1 and showing additional details of an exemplary form of one of the telescoping boom joints.

The boom 42 is preferably constructed of multiple parts, i.e., a plurality of thin, telescoping, aluminum tubes. In the exemplary disclosure of FIG. 1, there are first, second and third boom sections 42*a*, 42*b* and 42*c*, successively ¾" O.D., ⅝" O.D. and ½" O.D. joined by a joint 60 (FIG. 4). The wall thickness of such tubing is approximately 0.035 inches. It will be understood that other thin, light-weight material could be used as well, for example rigid plastic tubing, or stainless steel.

One illustrative boom joint which has been found to produce successful operating results is shown in FIG. 4. A groove 61 is embossed inwardly of the end of the boom section 42*b*. A circumferential groove 63 is correspondingly embossed inwardly of the end of the boom section 42*c*. An "O" ring sealing member 64 is seated in the groove 63 and is selected to have a sufficient thickness so that it projects radially outwardly and sealingly engages the shoulder provided by the groove 61 in the boom section 42*b*. The sealed joint thus provided not only seals liquid, but also serves as a detent means for retaining the boom sections 42*b* and 42*c* in their outwardly extended position.

However, the sections may be easily and readily telescoped when it is desired to collapse the boom 42 into its storage position as shown in FIGS. 11 and 12.

In order to offset the weight of a boom loaded with the liquid of a water stream, it is desirable to provide a counterbalancing means, which may take several forms. In the embodiment herein described and illustrated in detail, there is provided a spring loaded telescoping strut shown generally at 70, which may be conveniently made of aluminum tubes.

The strut 70 is rotatably carried by the gantry 10 for unison rotation with the boom 42 by means of a pipe sleeve 71 having its lower edge 72 coated with Teflon wearing surface abutting the adjoining bearing surface provided by a bearing sleeve 75 connected to the gantry 10 at the upper end of the union member 24. The pipe sleeve 71 has a channel bracket 74 connected in firm assembly therewith by means of a pair of screws 76 and nuts 77, which bracket 74 has a flange 78 to which the end of the strut 70 is pivotally attached by a cotter pin 79.

One of the parts of the telescoping strut 70 is a plunger element 70*a* which is continuously biased by a continuous biasing means such as a spring means 80. For example, in the illustrated embodiment of FIG. 1, two twelve inch long springs exerting about 1.36 pounds per inch of extension are disposed within the interior of the hollow tubular strut 70. The plunger element 70*a* has a pivot pin connection 81 to a flange 82 clamped by a pair of pipe clamps 83 and 84 to the boom section 42*a*.

FIG. 1 illustrates how the boom 42 can move from a "full flight" position (in full lines) to a "landed position" (phantom lines) In those corresponding modes, the strut 70 is in its fully extended position (full lines in FIG. 1) to its retracted position (phantom lines in FIG. 1).

Those versed in the art will recognize that the mechanical form of strut 70 could also take the form of a hydraulic strut by adding flex hose from the gantry 10 to the strut tube 70 and making the smaller tube 70*a* solid with an "O" ring seal and making the point of attachment to the boom 42 (parts 81–84) adjustable.

Yet another alternative is depicted in dashed outline on the left hand side of FIG. 1. That alternative would be to extend the boom diametrically in an opposite radial direction relative to the gantry 10 and add a counterweight 90 which would either augment, or completely replace, the strut 70.

The construction of the exemplary form of aircraft/sprinkler of the present disclosure can best be understood by referring to FIGS. 5–10 in conjunction with FIG. 1. A fuselage 100 made of closed cell polystyrene is hollowed out to form lightening recesses 101 and 102. A tail assembly stabilizer 103 can also be made of closed cell polystyrene so that it may be fused in firm assembly with the fuselage 100. In order to provide wear resistance, a thin hard plastic sheet 104 may be laminated on the foam surface of the tail assembly stabilizer 103.

An undercarriage 106 is provided for the fuselage 100 to form a landing gear and a motive means when the aircraft is grounded. In the aircraft of FIG. 1, the undercarriage 106 takes the form of a thin walled aluminum tube runner 107 coupled as at 108 to a spring loaded tube suspension 109, in turn, connected to the underside of the fuselage 100. A closed cell polystyrene ball 110 is connected to the leading end of the runner 107 for safety purposes and the runner 107 is curved as at 111 to provide a ski gliding surface to enhance sliding and gliding movement of the runner 107 on and over the turf of a lawn.

An aileron wing 120 is part of the tail assembly. It may also be provided with protective hard plastic sheeting 121 laminated to the wing surface. The airfoil, or wing, of the aircraft is identified at 125. As an exemplification of a satisfactory airfoil, the wing 125 is made of closed cell polystyrene and is similar to a wing available for the R/C E-Z BEE SPORT Model Airplane as manufactured and sold by Cox Manufacturing Co. Wear resistant laminated plastic sheeting may be placed on the wing 125 as shown at 124.

The wing 125 is mounted and secured on the fuselage 100 by means of a nylon stud 126 with a nylon washer 127 and nut 128. The wing profile is shown in FIG. 10. Thus, the dynamic forces produced by the movement of air over the upper and lower surfaces of the wing produce lift which will maintain a heavier-than-air airplane aloft.

The propulsion means of the aircraft illustrated in the drawings constitutes a plurality of jet thrusters. Thus, three thruster arms 140, 150 and 160 are spaced equilaterally relative to a center hub 170. The arms and the hub are each hollow to form water passages. The arms interconnect with the hub mechanically and hydraulically so that a stream of pressurized water furnished to the hub 170 will be carried through each of the arms 140, 150 and 160 to a corresponding jet nozzle 141, 151, and 161. The jet nozzles 141, 151, and 161 are constructed and disposed to discharge water in the form of a jet stream in a rearward direction, thereby creating a thrust acting to drive the aircraft forwards.

Figure 7:
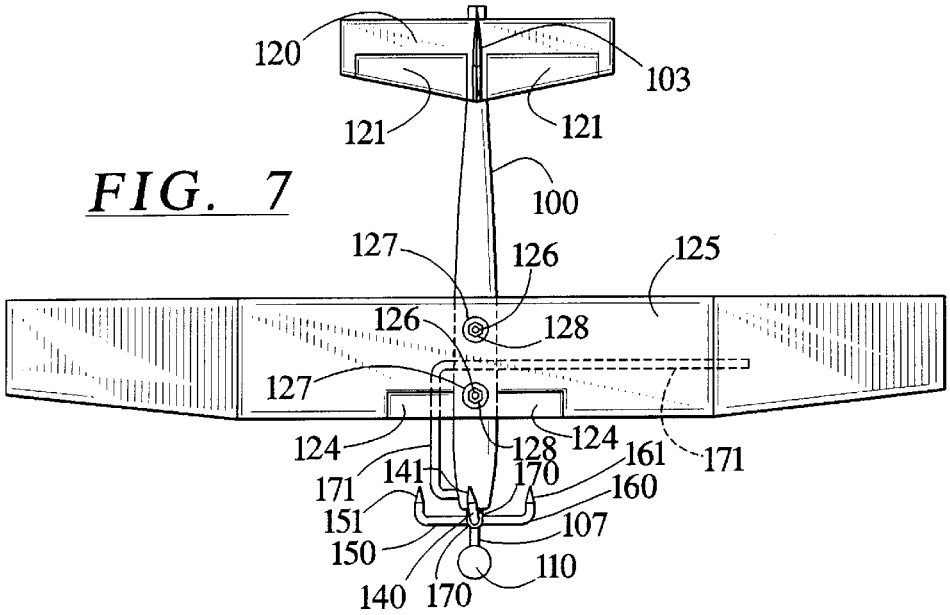
FIG. 7 is a top plan view of the airplane component of FIG. 6
Figure 6:
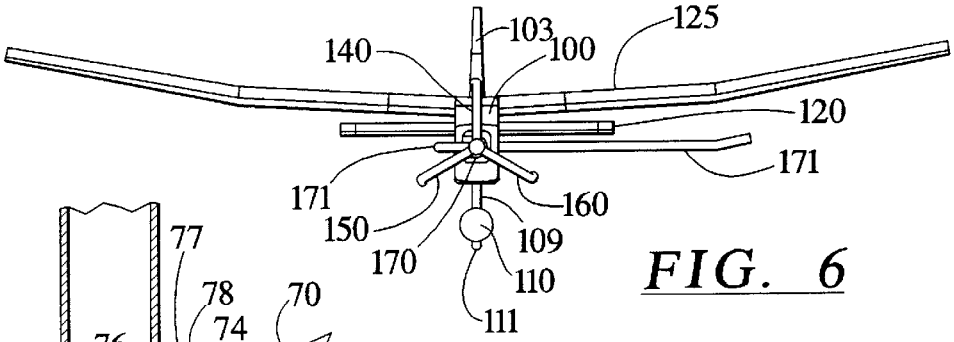
FIG. 6 is a front elevational view of the airplane component of the present invention.
Figure 3:
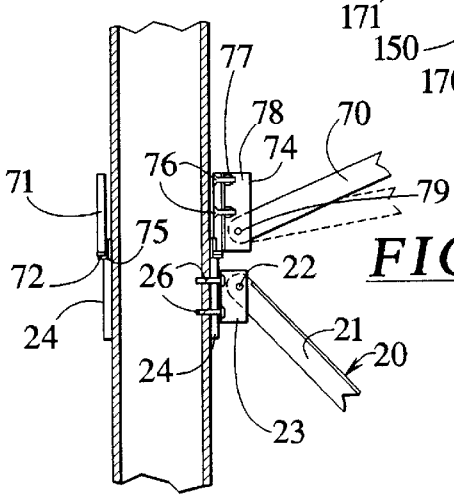
FIG. 3 is an enlarged fragmentary view showing additional details of the strut attachment to the gantry, as depicted in smaller scale in FIG. 1.
Figure 8:
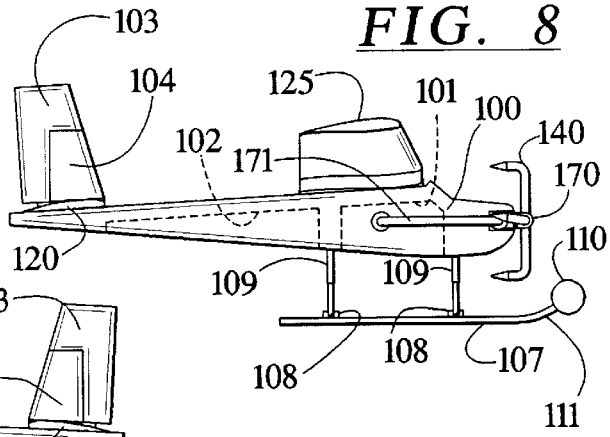
FIG. 8 is a right side view of the airplane component of FIG. 6.
Figure 9:
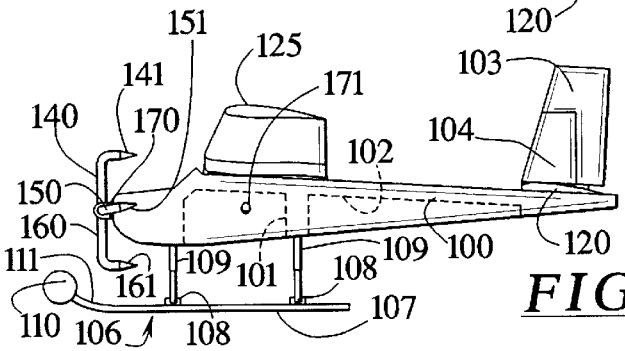
FIG. 9 is a left side view of the airplane component of FIG. 6.

The hub 170 is secured in the nose of the airplane fuselage 100 and is coupled to the end of a water feed line 171 extending longitudinally alongside the fuselage 100 (FIG. 8) and then extending transversely through the fuselage 100 and projecting from the left side of the fuselage 100 (FIGS. 6,7, and 9). The water feed line 171 is slightly canted to give the aircraft a more level attitude.

The thruster arms 140, 150 and 160 are configured to simulate the rotatable blades of a propellor on a propellor driven aircraft. A slight tilt of the nozzles 141, 151, and 161 will so direct the respective streams of water that there will be imparted a sufficient torque to rotate the blades of the propellor as well as to produce the requisite propulsion thrust.

To connect the aircraft to the boom 42 both mechanically and hydraulically, there is provided a quick-connect union coupling 180 having a first socket 181 which connects with the free end of the boom section 42*c* and a second socket 182 which connects with the end of the water feed line 171. Thus, the boom acts as a tether for the aircraft/sprinkler and also acts as a conduit, or pipe line, for delivering a stream of pressurized water to the aircraft/sprinkler.

In operation, the gantry is set in the lawn area to be watered and the coupling 12 is appropriately connected to a pressurized source of water via the coupling of the garden hose 17. By opening the valve 14 with the actuator 16, a stream of pressurized water will be caused to flow through the gantry 10, the boom 42 and to the water feed line 171.

In the take-off position, the strut 70 must carry all of the weight of the water filled boom 42 and most of the weight of the aircraft if the aircraft is to be driven over the grassy turf with sufficient speed to develop an elevating lift. However, the water jet thrust urges the aircraft to move forwards with the runner 107 sliding over the lawn surface and sufficient dynamic force is generated by the movement of the air over the surfaces of the airfoil that the aircraft and the boom 42 are readily lifted for take-off into a flight mode.

Since the boom, in effect, acts as a tether, the aircraft flies in a circular path around the vertical axis of the gantry 10. In horizontal flight at prevailing water system pressures of approximately 40 to 50 p.s.i., an aircraft as herein disclosed travels at approximately 18 feet per second and develops about 1.44 pounds of lift, which is sufficient to carry the weight of the aircraft plus a substantial proportional percentage of the weight of the water filled boom 42. Thus, in flight, the counter-balancing means need only support, or counter-act, a relatively small proportional percentage of the weight of the water filled boom 42.

Consequently, the operator of the system can vary the flow of liquid in the flow circuit and effectively maneuver the aircraft in various modes of aircraft performance: take-off, flight at different levels of altitude, and landing. Moreover, the jet discharge from the aircraft propulsion means is clean water and the discharge is dissipated, broadcast, and distributed over the entire expanse of the lawn surrounding the gantry 10, thereby achieving the utilitarian purposes of lawn watering while affording the operator the fun and sport of flying an aircraft which is directly responsive to manual regulation and control.

When not in use, the entire system folds up and collapses for convenient storage. As shown in FIGS. 11 and 12, the elements fold back upon themselves to provide a compact unit which may readily be suspended from a hook 200 on the wall of a storage area such as the garage of the user.

While various modifications might be suggested by those skilled in the art, it should be understood that I wish to embody within the scope of the patent warranted hereon all such modifications as reasonably and properly come within the scope of my contribution to the art.

I claim as my invention:

1. The method of operating a lawn sprinkler as an aircraft/lawn sprinkler having an airfoil means to generate dynamic lifting forces, which includes the steps of:

(1) flowing a pressurized water stream in the form of a flow circuit, (2) at one point in the flow circuit manually controlling the rate of flow of the water stream selectively and variably, (3) at a second point in the flow circuit utilizing a movable conduit means to accommodate an aircraft/sprinkler in take-off, flight and landing modes, (4) at a third point in the flow circuit directing the water stream into an airplane/sprinkler and converting the pressurized water stream into water jets, (5) generating propulsion thrust and driving the aircraft/sprinkler by directionalizing the water jets, and, (6) selectively varying the rate of flow in the flow circuit to drive the aircraft/sprinkler with sufficient thrust and speed as to generate dynamic lift forces on the airfoil so that the aircraft/sprinkler may take-off, be kept aloft in flight, and land, while broadcasting the water stream over the lawn area subjacent the flight path.

2. A water-powered airplane lawn sprinkler comprising, an aircraft having a fuselage, said fuselage carrying an airfoil for generating dynamic lift forces when air is passed over the surfaces thereof, propulsion means connected to said fuselage comprising a plurality of water jet nozzles disposed to project jets of water so that a driving thrust is delivered to the aircraft, an undercarriage for said fuselage for sliding and gliding on an underlying lawn surface when the aircraft is propelled forwards during take-off and landing, a portable gantry adapted to be erected at a zone of utilization in a lawn to be sprinkled, a boom rotatably coupled to said gantry mechanically and hydraulically, and means forming a water stream feed line means through said gantry, said boom and to said propulsion means, whereby water jets drive said aircraft in the modes of take-off, flight, and landing, while watering the lawn subjacent the flight path.

3. A water powered aircraft/sprinkler comprising a lawn sprinkler having means forming a water passage adapted to be connected to a domestic supply source of pressurized water, nozzle jet means on said lawn sprinkler connected to said means forming a water passage and further including means to directionalize a water jet projected therefrom to produce a propulsion thrust to move the lawn sprinkler, and an airfoil on said lawn sprinkler formed with surfaces to produce a lift when air is passed thereover sufficient to sustain the lawn sprinkler in a flight mode.

4. A lawn sprinkler system comprising, in combination, (A) tethering means including an upright gantry disposed on a vertical axis and having a radially extending horizontal boom rotatably connected to the upper end thereof for movement through a circular path around said vertical axis, (B) an aircraft/sprinkler unit connected to the radially outermost end of said boom, (C) said tethering means and said aircraft/sprinkler unit having water passage means adapted to be connected to a valve controlled pressurized water source and carrying water in the form of a variably pressured stream, (D) said aircraft/sprinkler unit having directionalized water jets through which said stream is directed to thrust the aircraft/sprinkler unit in a circular path determined by said boom at speeds correspondingly varying as a function of the variably pressured stream, (E) said aircraft/sprinkler unit further including air foil means shaped to generate dynamic lifting forces as said aircraft/sprinkler unit is driven selectively through said circular path in take-off, flight and landing modes, whereby said aircraft/sprinkler unit can be flown as the water jets are broadcast beneath the flight path.

5. The invention of claim 4 and further characterized by, said tethering means (A) including counterbalancing means to assist in counteracting the weight of the boom when it is filled with water.

6. The invention of claim 5 wherein said counterbalancing means comprises a strut disposed between said gantry and said boom, said strut having a continuous biasing means to apply an upward biasing force against said boom for the purposes set forth.

7. The invention of claim 6 wherein said strut constitutes a mechanical strut having continuous biasing means in the form of pre-stressed spring means.

8. The invention of claim 6 wherein said strut constitutes a hydraulic strut connected to said gantry and having means to apply hydraulic forces to said boom for the purposes set forth.

9. The invention of claim 5 wherein said counterbalancing means comprises a counterweight connected to an extension of said boom projecting radially from said vertical axis in a direction diametrically opposite the longitudinal direction of said boom.

10. In a lawn sprinkler system, the improvement of, an upright hollow gantry having a fluid coupling for attachment to a domestic supply of pressurized water and adapted to be erected on a vertical axis on a lawn site to be watered, a hollow boom rotatably coupled to said gantry and being movable through a circular path around said vertical axis, and an aircraft/sprinkler unit coupled to said boom mechanically and hydraulically so that a supply of pressurized water in the form of a stream is selectively driven through said gantry and said boom to said aircraft/sprinkler unit, said aircraft/sprinkler unit comprising a portable aircraft having water powered propulsion means, an airfoil means, a stabilizer tail assembly, and an undercarriage means, whereby said aircraft/sprinkler unit can be operated through tethered take-off, flight and landing modes, while broadcasing said stream of water over the lawn site.

11. The invention of claim 10, wherein said hollow boom comprises a plurality of telescoping tubes made of light-weight rigid material so that said boom may be selectively extended and retracted between an operational position and a storage position.

12. The invention of claim 10 wherein said gantry and said boom are provided with counterbalancing means for offsetting some of the weight of the water filled boom sufficiently to promote take-off, and flight of the aircraft/sprinkler unit.

13. The invention of claim 10 and further characterized by said aircraft comprising a jet propelled airplane having water powered propulsion means comprising a plurality of nozzles projecting directionalized water jets from said stream to produce and apply propulsion thrust to the airplane.

14. The invention of claim 10 and further characterized by said aircraft comprising a helicopter aircraft having a rotor means and said water powered propulsion means rotatably drives said rotor.

15. The invention of claim 10 and further characterized by said aircraft comprising a jump-jet airplane and said water powered propulsion means comprises water jet nozzles disposed to drive said aircraft/sprinkler unit.

16. The invention of claim 10 and more particularly comprising:

said aircraft/sprinkler unit taking the physical form of an airplane having, a fuselage having an undercarriage, an airfoil wing carried by said fuselage, a tail stabilizer assembly connected to the rear end of said fuselage and comprising an upright tail and a horizontal tail wing, said fuselage having a water feed line for interconnection between said water powered propulsion means and said boom.

17. The invention of claim 16 wherein said undercarriage comprises a ski runner adapted to slide and glide on the adjoining surface of the lawn site.

18. The invention of claim 17 wherein said undercarriage includes a spring suspension means for mounting and connecting said runner to said fuselage.

19. The invention of claim 17 and a polystyrene ball on the front end of said ski runner forming a protective safety cushion for the aircraft/sprinkler unit.

20. The invention of claim 10 and further characterized by a manually operated flow regulating valve means to selectively regulate the water stream, thereby to control the take-off, flight and landing modes of the aircraft during the watering of the lawn site.

21. The invention of claim 16 wherein said airfoil wing, said tail and said tail wing are provided with protective sheeting on the surfaces thereof to protect against water abrasion.

* * * * *